US006786615B2

(12) United States Patent
Hendricks

(10) Patent No.: US 6,786,615 B2
(45) Date of Patent: Sep. 7, 2004

(54) WEIGHTED FLASHLIGHT

(76) Inventor: Robert R. Hendricks, 43 Boonesbourgh, St. Charles, MO (US) 63303

( * ) Notice: Subject to any disclaimer, the term of this patent is extended or adjusted under 35 U.S.C. 154(b) by 0 days.

(21) Appl. No.: 10/352,017

(22) Filed: Jan. 27, 2003

(65) Prior Publication Data

US 2004/0145889 A1 Jul. 29, 2004

(51) Int. Cl.[7] ..... F21V 33/00
(52) U.S. Cl. ..... 362/109; 362/102; 362/208
(58) Field of Search ..... 362/102, 109, 362/208, 253, 157, 196, 115, 118, 202, 218

(56) References Cited

U.S. PATENT DOCUMENTS

| | | | | | |
|---|---|---|---|---|---|
| 2,855,499 | A | | 10/1958 | Lewis | |
| 2,908,901 | A | | 10/1959 | Lewis | |
| 3,737,649 | A | * | 6/1973 | Nelson et al. | 362/102 |
| D255,139 | S | | 5/1980 | Smith | |
| 4,479,171 | A | | 10/1984 | Mains | |
| 4,506,889 | A | | 3/1985 | Lewis | |
| 4,703,402 | A | | 10/1987 | Hsieh | |
| 4,744,013 | A | | 5/1988 | Lee et al. | |
| 4,835,665 | A | | 5/1989 | Kao | |
| 5,060,123 | A | * | 10/1991 | Arnold | 362/102 |
| 5,079,679 | A | | 1/1992 | Chin-Fa | |
| 5,081,568 | A | | 1/1992 | Dong et al. | |
| 5,086,377 | A | | 2/1992 | Roberts | |
| 5,105,309 | A | | 4/1992 | Baravaglio et al. | |
| 5,165,782 | A | | 11/1992 | Maglica et al. | |
| 5,287,255 | A | | 2/1994 | Strodtman | |
| 5,309,337 | A | | 5/1994 | Groben | |
| 5,363,285 | A | * | 11/1994 | Wideman | 362/102 |
| D354,328 | S | | 1/1995 | McCarty | |
| 5,556,003 | A | * | 9/1996 | Johnson et al. | 222/39 |
| 5,697,700 | A | * | 12/1997 | Huang | 362/259 |
| 5,901,723 | A | * | 5/1999 | Ames | 135/66 |
| 6,139,165 | A | * | 10/2000 | Crowe | 362/102 |
| 6,199,997 | B1 | * | 3/2001 | Outsen et al. | 362/109 |
| 2002/0159248 | A1 | * | 10/2002 | Evenson | 362/102 |

* cited by examiner

*Primary Examiner*—John Anthony Ward
(74) *Attorney, Agent, or Firm*—Paul M. Denk

(57) ABSTRACT

The weighted end cap for a flashlight, replacing the standard end cap of such a light, including a weighted component generally hemispherical in configuration, integrally formed with a polygonally sided component, to prevent rolling of the flashlight during usage, and having an integral sleeve extending downwardly therefrom, presenting threads, generally of the external type, for use in threading into the end of a standard flashlight, now allowing the flashlight to be used as a tool, weapon, in addition for the standard lighting purposes, and to prevent its rolling or movement when rested upon a surface as during non-usage or storage.

4 Claims, 4 Drawing Sheets

WEIGHTED FLASHLIGHT

BACKGROUND OF THE INVENTION

This invention relates generally to a flashlight, which has been modified to provide enhanced weight, allowing the instrument to also be used for security and for purposes requiring enhanced weight during usage.

Obviously, there are many types of flashlights on the market. There are many types of weighted hammer devices available. And, various instruments, because of their configuration, generally retard shifting, once emplaced, but the flashlight, in many instances, has a tendency to roll, when rested.

The current invention is designed to provide a weighted flashlight, that can be used as an instrument, a defensive weapon, used as a hammer when required, inherently incorporates means to prevent its rolling or unauthorized shifting, but at the same time, can readily provide light, in the manner of a standard flashlight, when needed. More specifically, this invention has significant utility in the airline industry, as for use by pilots, when on duty, and flying.

The applicant has been in the airline business for over twenty years. Recent events have dictated the need for additional cockpit security measures. The pilot could carry with him a form of police baton, or even a hammer, or any other type of weapon that may be authorized by the FAA, and usually, the pilot always carries a flashlight, for a variety of purposes. The current invention is designed to provide for a combination of all of these elements, into a single instrument, namely, a flashlight, and readily available for usage for a variety of purposes.

For example, the prior patent to Strodtman, No. U.S. Pat. No. 5,287,255, shows a combination flashlight-baton. In it, while a flashlight may be embodied in the frontal portion of the instrument, the back end includes a telescopic baton, that may extend outwardly, and be used in that manner, but also as a weapon, when needed.

The patent to Maglica, et al., U.S. Pat. No. 5,165,782, shows a molded thermoplastic accessory cover for attachment to a flashlight, and in its structure, apparently includes one or more flat surfaces to inhibit rolling of the assembled cover and flashlight.

The patent to Arnold, U.S. Pat. No. 5,060,123, shows a flashlight carrying baton, not too unlike that of the previous Strodtman reference.

The patent to Chin-Fa, U.S. Pat. No. 5,079,679, shows a multi-purpose traffic directors stick, which includes a flashlight, its handle, the lamp element, and an extending stick for use for direction purposes.

The use of multiple components, within a single instrument, can be seen in the patent to Phillips, U.S. Pat. No. 4,625,742, disclosing a multi-function lighted walking cane.

The patent to Hsieh, U.S. Pat. No. 4,703,402, shows a flashlight with alarm and rescuer means.

The patent to Lee, et al., U.S. Pat. No. 4,744,013, shows an illuminable and soundable baton.

The patent to Kao, U.S. Pat. No. 4,835,665, shows an emergency type of flashlight.

The patent to Smith, U.S. Pat. No. DES.255,139, shows an electric baton for law enforcement personnel.

The patent to Maines, U.S. Pat. No. 4,479,171, shows a side arm style of baton and combined flashlight. It does include a plug at its end opposite the light.

U.S. Pat. No. 5,079,679, shows a multi-purpose traffic directors stick.

The patent to Lewis, U.S. Pat. No. 4,506,889, discloses a different style of protective device, for use for self defense, having a loop member at one end and a sleeve extending therefrom.

The patent to Roberts, U.S. Pat. No. 5,086,377, discloses a personal accessory and defense baton, of a more complex design.

The patent to Baravaglio, et al., U.S. Pat. No. 5,105,309, shows a signaling baton, which may be used by the police authorities. The patent to Dong, et al., U.S. Pat. No. 5,081,568, shows a traffic police baton with means to indicate the direction in the night.

The patent to DiVito, et al., U.S. Pat. No. 4,583,080, shows an audible alarm and projection lamp attachment for a walking cane.

A similar type invention is shown in the prior patent to Bolen, U.S. Pat. No. 4,062,371, upon a walking cane.

The patent to Lewis, U.S. Pat. No. 2,908,901, shows a combined night stick, flashlight, and audible alarm.

A different style of flashlight is shown in another patent to Lewis, U.S. Pat. No. 2,855,499.

The current invention is designed to incorporate some of the broad features as shown in prior art devices, generally adapting the structure of a flashlight, such as a MAG LITE, so that it can be used for security purposes, as a weapon, for force applying purposes, but yet, retaining its ability to function as a flashlight, and further including means to prevent its movement, when at rest.

BRIEF SUMMARY OF THE INVENTION

The concept of this invention is to provide a replacement end cap for a standard type of flashlight, such as the standard D cell MAG-LITE, so as to compound the uses to be made of the flashlight, when required. The replacement end cap is weighted, and rounded for use as a possible defensive weapon, similar to a police baton, which may be used to hit or jab an assailant, such as might be encountered by an airline pilot, while on duty and flying. The area directly under the rounded end cap, or just forwardly thereof, is shaped into a square, or other polygonal design, so that the flashlight will not roll when placed on a horizontal surface, such as upon a tray, or on the floor of the cockpit, as when not in use. The flattened area to the end cap prevents the rolling of the light, and allows the unit to be placed parallel to a surface, and stay in place, so the pilot has the assurance that the light, weapon, or other means is readily available, where it was placed, for immediate access and usage.

This type of device can also be used by the pilot as a hammer, or as a slide hammer, and this is particularly useful due to the design of the new cockpit door latching devices, which rely upon long metal bars, which are prone to jamming, as in the case of a crash or hard landing, but which will require a hardened surface, such as the multi-sided heavy weight end cap of this invention, for use for force applying and hammering purposes, as required. In addition, since the end cap of this invention is not too great a dimension, beyond that of the standard end cap for a flashlight, such as a MAG-LITE, it is designed to fit vertically into a standard size flight kit, of the type that are customarily used by pilots, currently.

In addition, since the end cap of this invention is made of electrically conducting metal, the normal functionality of the standard flashlight is unaffected, and the proper transfer of electrical energy, as required for usage of the is flashlight, can still be accomplished.

Flashlights are not new, nor are batons, as previously reviewed. The prior art shows the use of flashlights, as patented, that are also specifically designed for application as batons. What is new with this current concept is that you can convert a standard flashlight, such as a MAG-LITE, that the party already owns, into a combination of a related baton, so that it can be used as an escape tool, or as a weapon, and this can be done simply through the purchase of the converted screw-on end cap, of this invention. The polygonal or square end of the cap retards rolling, which can be a problem, particularly in aircraft, since it may encounter frequent inclines, which would otherwise cause rolling of a flashlight, as placed upon the floor, taking it away from the pilot, for ready usage in the case of an emergency. Now you can lay a flashlight, incorporating the end cap of this invention, down on the floor of a cockpit, or even in a car, trunk, or perhaps even next to one's bed, and have it readily available for usage, without concern or worry about its rolling away.

It is, therefore, the principal object of this invention to provide a revision to the end cap of a flashlight, that has significant weight, retards rolling, can be used as a weapon or a tool, without sacrificing any of the attributes of the flashlight itself.

Another advantage of this current invention is to provide a replacement end cap, that may be applied to many different styles of flashlights, and converted for multi-usage purposes, as explained.

Another object of this invention is to provide a converted flashlight that may be used as a weapon.

Still another object of this invention is to provide a flashlight that may be converted for use as a tool.

Yet another object of this invention is to provide a flashlight that may be converted for multi-purposes, and is adapted to function more effectively when in usage, by remaining in place, once located.

These and other objects will become more apparent to those skilled in the art upon review of the summary of invention as provided herein, and upon undertaking a study of the description of its preferred embodiment, in view of the drawings.

DESCRIPTION OF THE PREFERRED EMBODIMENT

Figure 1:
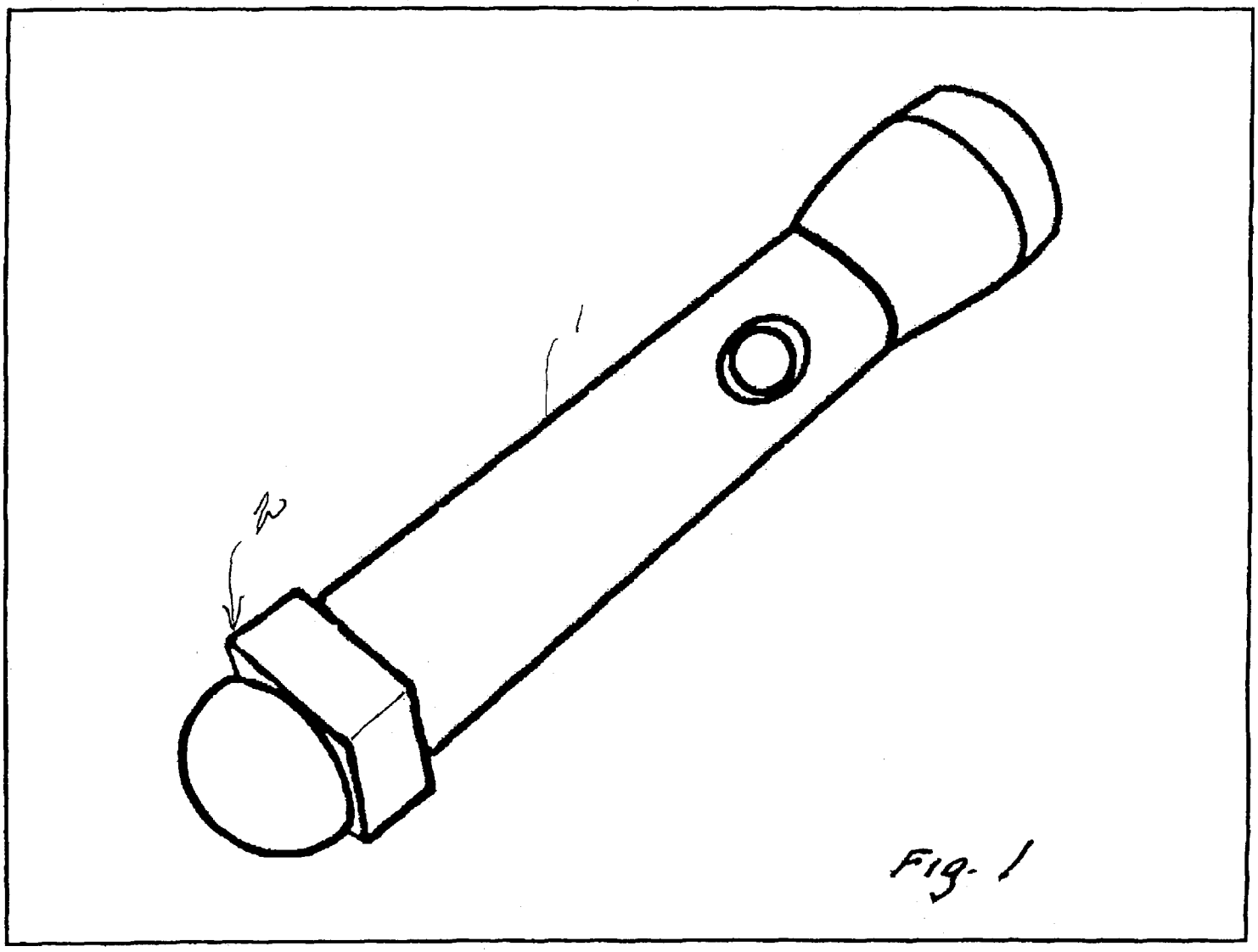
FIG. 1 is a isometric view of a flashlight incorporating the end cap of this invention.
Figure 2:
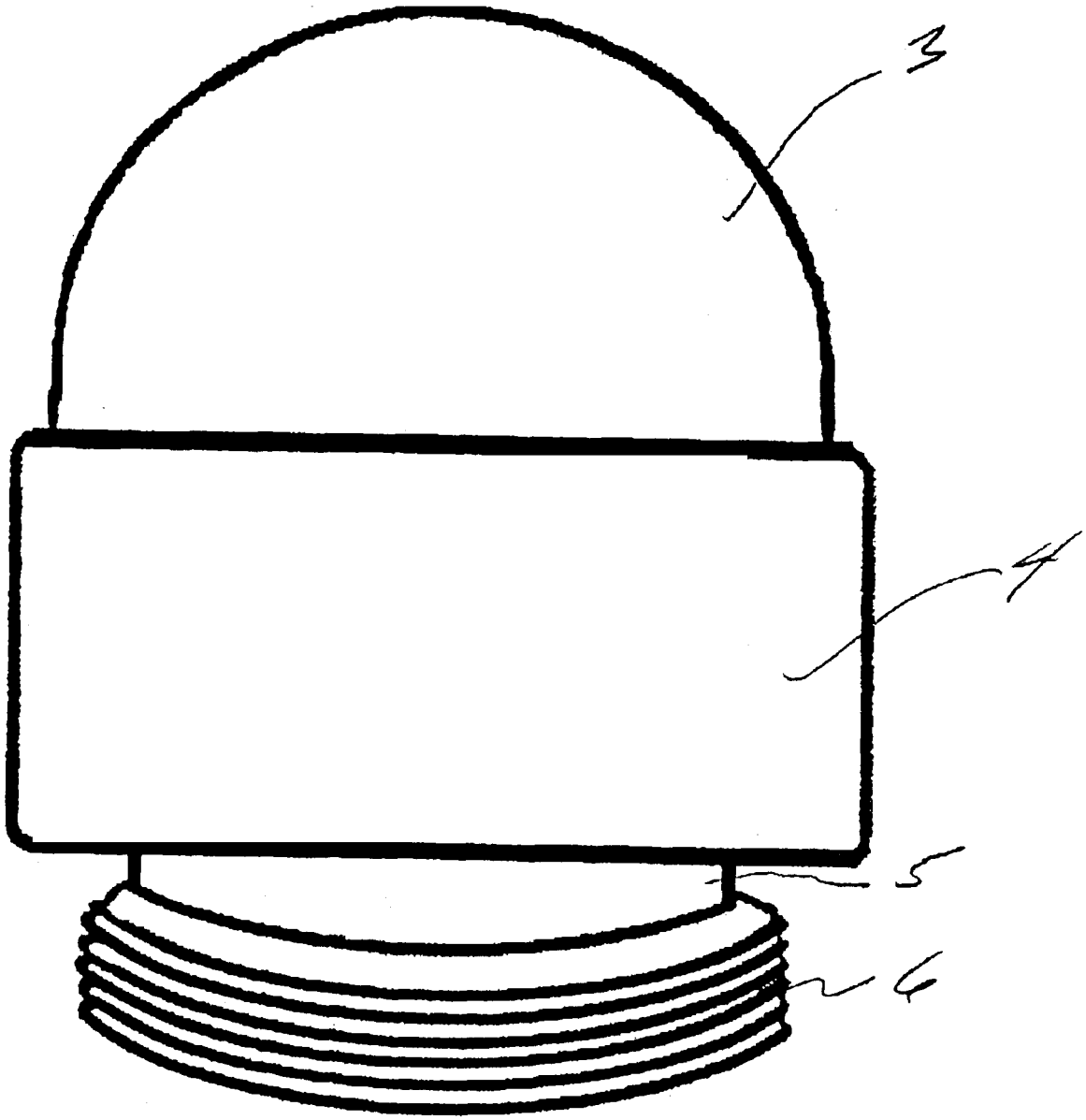
FIG. 2 is a side view of the end cap of this invention.

In referring to the drawings, and in particular FIG. 1, an embodiment of this invention is shown, including a flashlight 1, which in this instance, may comprise a MAG-LITE, of the 3-cell D flashlight size, as can be noted. To the back end of the flashlight is the replaceable end cap 2 of this invention. As can be also noted in FIG. 2, it includes a substantially weighted segment 3 which is semi-hemispherical in shape, and it includes downwardly therefrom, a multi-sided configuration integral portion, likewise of the same weighted metal, and in this particular instance, comprising a four sided integral component 4, downwardly from this portion is an extending cylindrical segment 5, which is formed into a configuration of a threaded portion 6, containing sufficient threads to provide for its internal threading into the back end of the flashlight, after its normal rear cap (not shown) has been removed. Obviously, many other configurations could be used for the shape of these various integral components, such as the polygonal shape member 4 may be five sided, six sided, or the like, and still function to provide the additional of significant weight to the end cap, for use for the variety of purposes as previously explained, and likewise, yet provides sufficient flattened surface to prevent the rolling of the flashlight, when rested upon the floor, table, or any other supporting surface. In addition, the rounded or mounded portion 3, extending upwardly, as shown, may undertake other shapes. The essence of the invention is to provide for a significantly weighted member, which may weigh in the vicinity of one pound, more or less, but yet adds significant weight to the lengthy flashlight, at this location, to be used for the purposes as previously explained, either as a weapon, tool, or the like.

Figure 4:
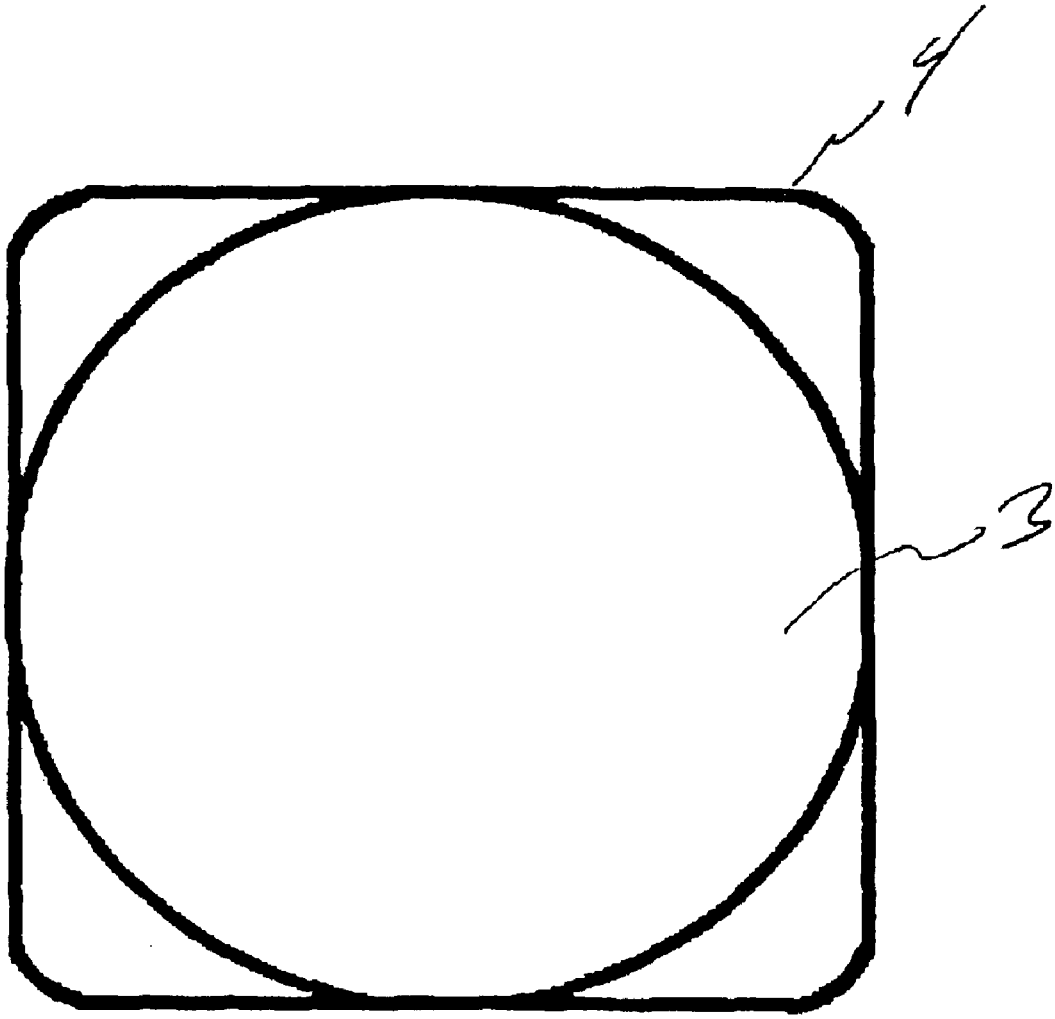
FIG. 4 is a top plan view of the end cap of this invention.

The general relationship between the mounded surface or semi-hemispherical shape 3, and the polygonal or multi-sided portion 4 can be readily noted from the top view as shown in FIG. 4.

Figure 3:
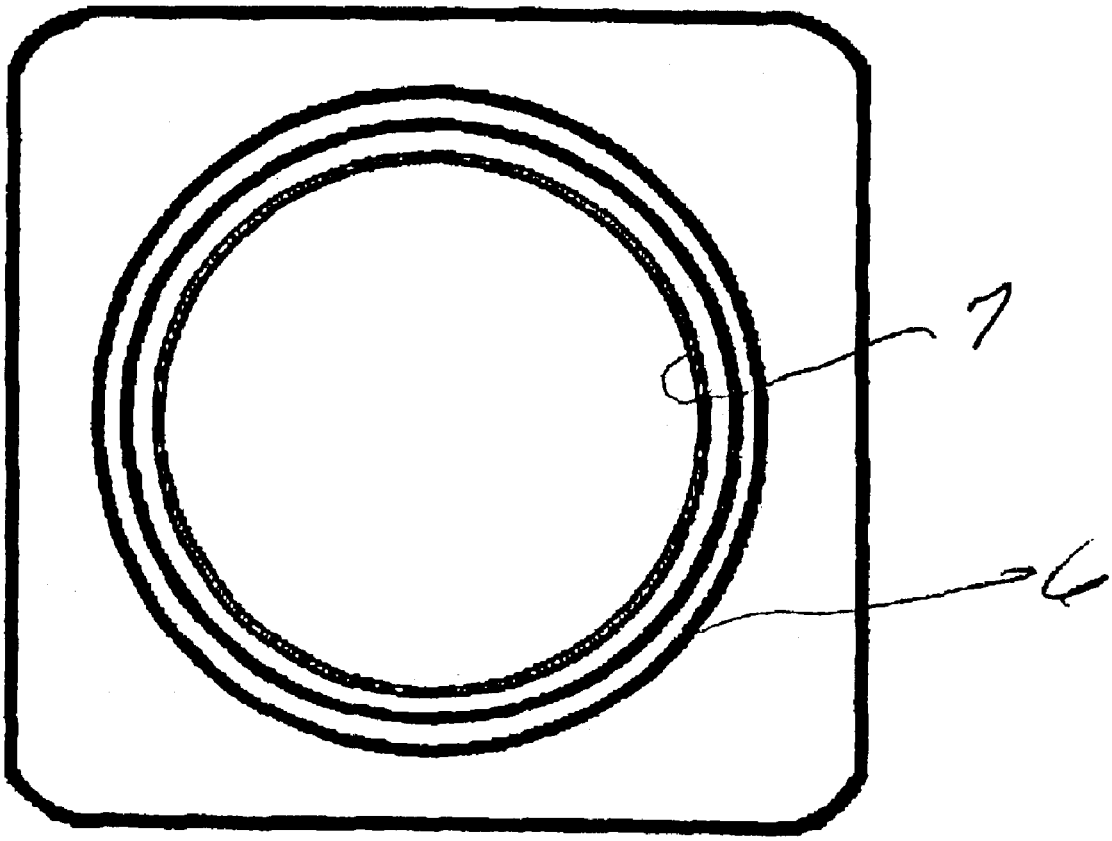
FIG. 3 is a lower end view of the end cap.

As can further be noted in FIG. 3, which is the bottom view of the end cap, there is provided a cavity 7 that extended inwardly from the bottom of the threads 6, for a distance of approximately ½ to 1 inch, and preferably in the ¾ inch range, and which functions to provide a seat, for the normal spring included and used in a flashlight of this design, that biases against the enclosed and aligned batteries, and likewise furnishes electrical contact for the transmission of electrical energy, for lighting the flashlight, when employed.

Obviously, the end cap of this design can be of a variety of sizes, depending upon the type of flashlight to which it will be applied, and while normally in the preferred embodiment, the threaded relationship 6 of the sleeve 5, provides external threads for threadedly engaging internally within the flashlight, it may be likely, in some instances, that the end cap will be threadedly applied to the exterior of the back end of the flashlight, depending upon the make and manufacture of the flashlight product.

Obviously, various changes could be made to the structure of this invention, for use depending upon the trade or profession involved, as for example, the auto mechanic may buy the end piece to keep the flashlight from rolling away, particularly when working in confined places located around or under the automobile, so the weighted portion may be reduced, and a one pound weight through the addition of the semi-hemispherical part of the end cap, may be replaced with a more flattened configuration, to reduce weight, but yet afford the polygonal surface that prevents rolling. The police market may not necessarily desire to have a square end cap, but still requires the heavy weight, and therefore, the polygonal component 4 may be more rounded, so as to facilitate the insertion of the flashlight into a trouser pocket, or into a flashlight holder, of the type that the enforcement authorities may employ. Furthermore, using a more rounded type of polygonal surface may reduce the excessive trauma that may occur, in the event that the weighted flashlight is employed as a club by the policemen, during usage.

The type of metal used in the fabrication of this device is preferably steel, iron, or the like, but even a heavy weight polymer might be used, or aluminum, to reduce weight but yet afford all of the attributes desired from a replaceable end cap of the type of this invention.

Other variations or modifications to the subject matter of this invention may occur to those skilled in the art upon review of the disclosure provided herein. Such variations, if within the spirit of this development, are intended to be encompassed within the scope of the invention as defined. The description of the preferred embodiment, and is illustrated in the drawings, is set forth for just that purpose, for illustration purposes only.

What is claimed is:

1. A weighted flashlight of the type incorporating a casing provided for holding one or more batteries, and having electrical contact with a lensed lamp at its forward end, the back end of the flashlight incorporating a weighted end cap segment for use for application of a force as required, the weighted end cap segment threadly engages with the flashlight casing, and the weighted end cap, with the flashlight, capable of being applied as one of a tool and weapon, the weighted end cap includes a weighted hemispherical segment providing a smooth surface when applied, a multi-sided configuration integrally extending from the hemispherical segment, said multi-sided configuration provided for preventing the flashlight from rolling when placed upon a surface, and a cylindrical segment extending integrally from the multi-sided configuration, the multi-sided configuration incorporating threads for threadly engaging to the back end of the flashlight casing when assembled.

2. The weighted flashlight of claim 1 wherein the multi-sided integral portion is of a four sided shape.

3. The weighted flashlight of claim 1 wherein the multi-sided integral portion includes at least three or more sides.

4. The weighted flashlight of claim 3 wherein the weighted end cap weighs at least one pound.

* * * * *